US006133931A

United States Patent [19]

Yoshikawa et al.

[11] Patent Number: 6,133,931

[45] Date of Patent: Oct. 17, 2000

[54] THERMAL RECORDING METHOD AND INK SHEET USED THEREIN

[75] Inventors: Masanori Yoshikawa, Osaka; Atsushi Sogami, Hyogo; Kouji Ikeda; Yoshihisa Fujimori, both of Osaka; Nobuyoshi Taguchi, Nara, all of Japan

[73] Assignee: Matsushita Electric Industrial Co., Ltd., Osaka, Japan

[21] Appl. No.: 08/644,785

[22] Filed: May 10, 1996

Related U.S. Application Data

[63] Continuation of application No. 08/149,380, Nov. 9, 1993.

[30] Foreign Application Priority Data

Nov. 9, 1992 [JP] Japan ..... 4-298281

[51] Int. Cl.[7] ..... B41J 2/325

[52] U.S. Cl. ..... 347/213; 347/217

[58] Field of Search ..... 347/213, 217

[56] References Cited

U.S. PATENT DOCUMENTS 5,168,289 12/1992 Katakabe et al. ..... 347/213
5,263,781 11/1993 Mima et al. ..... 347/213
5,284,814 2/1994 Taguchi et al. ..... 503/227
5,367,322 11/1994 Sogami et al. ..... 347/213

OTHER PUBLICATIONS

U.S. application No. 08/044002, filed Apr. 8, 1993.

*Primary Examiner*—Huan Tran
*Attorney, Agent, or Firm*—McDermott, Will & Emery

[57] ABSTRACT

A thermal recording method, using a thermal recording apparatus comprising an intermediate recording medium made of silicone rubber layer, of which surface thickness is 1 mm or less, surface roughness is 5 microns or less, contact angle cosine is 0.4 or less, density is 0.90 to 1.15, and rubber hardness is 20 to $50^{HS}$, a fixing roll, and a thermal recording head, and an ink sheet of which viscosity of colored material on the substrate at 100° C. is 500 to 2,000,000 cps, for selectively heating the colored material on the ink sheet by the thermal recording head to transfer the colored material on the intermediate recording medium so as to record characters and images, and passing the image receiving medium such as recording paper between pressing parts of the intermediate recording medium and the fixing roll, and transferring or fixing the characters and images by the colored material transferred on the intermediate recording medium onto the recording paper so as to be recorded, and an ink sheet used therein.

10 Claims, 12 Drawing Sheets

THERMAL RECORDING METHOD AND INK SHEET USED THEREIN

This application is a continuation of Ser. No. 08/149,380, filed Nov. 9, 1993.

FIELD OF THE INVENTION

The present invention relates to a thermal recording method capable of recording high quality images at high speed on a plain paper or a bond paper, and an ink sheet used therein.

BACKGROUND OF THE INVENTION

The thermal transfer printing technique has been generally known as an art of softening a thermally fusible ink on an ink sheet by a thermal head, and directly transferring and recording on an exclusive image receiving medium such as thermal transfer paper. Other recording technique is recently reported, in which a thermally fusible ink is transferred once on a drum- or belt-shaped intermediate recording medium of which surface is made of silicone rubber or the like, and this ink is transferred again on a paper. This; technique is proposed to solve the problems experienced in the general thermal transfer recording technique without using intermediate recording medium in which it was difficult to print and record at high quality without voids or other defects on plain paper or bond paper other than thermal transfer paper. This method is capable of recording uniformly because of the homogeneity and flexibility of the silicone rubber, and transferring and fixing the ink recorded on the rubber, smoothly along surface irregularities of the paper owing to the flexibility of rubber. The silicone rubber used herein is fabricated in a hardness range of 30 to $50^{HS}$ by using, for example, dimethly silicone, and copolymerizing and crosslinking with methyl butyl silicone, and adding inorganic filler such as silicon.

In the thermal transfer recording method using the intermediate recording medium with the surface covered with silicone rubber stated above, it is possible to print and record at high quality on a plain paper. Generally, the silicone rubber formed in a drum shape is required to possess properties of ink receptivity when recording, and ink releasability when transferring. However, when the drum-shaped silicone rubber intermediate recording medium is used continuously, the releasability of the rubber surface deteriorates, and the ink on the silicone rubber is not completely transferred onto paper or other image receiving medium, and is left over on the rubber surface, thereby impairing the image quality. It is conceivable that the deterioration in ink releasability is attributable to the increase of roughness of rubber surface due to friction against the paper, or to the decrease of oil quantity in the rubber, when silicone oil is added to the silicone rubber in order to improve the releasability, due to the transfer of the silicone oil to the paper. Because of these reasons, in the conventional thermal recording method using intermediate recording medium made of silicone rubber and thermally fusible ink, the number of transfers by the intermediate recording medium was limited to about several thousand times. Besides, the thermally fusible ink used in such method is required to be easily adhered on a material very low in surface energy such as silicone rubber when forming an image, and, to the contrary, to be completely transferred to the paper without being left over on the intermediate recording medium at the time of transfer. However, the existing thermal transfer recording ink is designed to be transferred directly on the material having a high ink receptivity such as paper, and when the ink was used in the indirect thermal recording method by using the intermediate recording medium, recording on silicone rubber and transferring on paper could not be satisfied at the same time.

SUMMARY OF THE INVENTION

It is hence a primary object of the invention to present a thermal recording method capable of recording characters and images of high quality on plain paper or bond paper stably for tens of thousand to hundreds of thousand times, and an ink sheet to be used therein.

The invention presents a thermal recording method, using a thermal recording apparatus comprising an intermediate recording medium made of silicone rubber layer, at least, of which surface thickness is 1 mm or less, surface roughness is 5 microns or less, contact angle cosine is 0.4 or less, density is 0.90 to 1.15, and rubber hardness is 20 to $50^{HS}$, a fixing roll for pressing against the intermediate recording medium, and a thermal recording head, and an ink sheet of which viscosity of colored material on the substrate at 100° C. is 500 to 2,000,000 cps, for selectively heating the colored material on the ink sheet by the thermal recording head to transfer the colored material on the intermediate recording medium so as to record characters and images, and passing the image receiving medium such as recording paper between pressing parts of the intermediate recording medium and the fixing roll, and transferring or fixing the characters and images by the colored material transferred on the intermediate recording medium onto the recording paper so as to be recorded.

The invention also provides an ink sheet to be used in a thermal recording apparatus comprising an intermediate recording medium made of silicone rubber layer, at least, of which surface thickness is 1 m or less, surface roughness is 5 microns or less, contact angle cosine is 0.4 or less, density is 0.90 to 1.15, and rubber hardness is 20 to $50^{HS}$, a fixing roll for pressing against the intermediate recording medium, and a thermal re cording head, for selectively heating the colored material on the ink sheet by the thermal recording head to transfer the colored material on the intermediate recording medium so as to record characters and images, and passing the image receiving medium such as recording paper between pressing parts of the intermediate recording medium and the fixing roll, and transferring or fixing the characters and images by the colored material transferred on the intermediate recording medium onto the recording paper so as to be recorded, wherein the viscosity of the colored material on the substrate at 100° C. is 500 to 2,000,000 cps.

The ink sheet of the invention is composed by applying a colored material layer about twice as much as the required colored material in order to obtain a desired concentration on one surface of the substrate, and destroying the cohesion of the colored material layer from about the middle of the thickness direction when forming characters and images on the intermediate recording medium, thereby transferring onto the intermediate recording medium.

The ink sheet of the invention is composed by laminating a parting layer and a colored material layer on one surface of a substrate by approximately a same amount in the sequence of the parting layer and colored material layer from the substrate side, and destroying the cohesion near the interface of the colored material layer and parting layer when forming characters or images on the intermediate recording medium, thereby transferring the colored material layer onto the intermediate recording medium.

The ink sheet of the invention is prepared by laminating first layer and second layer on one surface of a substrate, alternately by four layers or more, and the first layer is a colored material layer, and the second layer is a colored material layer or a parting layer in a resin composition largely different in viscosity from that of the colored material or not compatible therewith.

The ink sheet of the invention is also prepared by laminating a first colored material layer, a parting layer, and a second colored material layer on one surface of a substrate sequentially from the substrate side, and the thickness of the colored material layer is applied twice as much as the second first colored material necessary for obtaining a desired concentration.

The ink sheet of the invention is also composed by laminating a parting layer of which viscosity at 100° C. is 500 cps or less and a colored material layer on one surface of a substrate in the sequence of parting layer and colored material layer from the substrate side, and separating at the interface of the colored material layer and parting layer, or destroying the cohesion of the parting layer when forming characters or images on an intermediate recording medium, thereby transferring the colored material layer onto the intermediate recording medium.

The ink sheet of the invention is also composed by laminating a parting layer of which viscosity at 100° C. is 500 cps or less and a colored material layer on one surface of a substrate in the sequence of parting layer and colored material layer from the substrate side, and destroying the cohesion from about the middle of the combined thickness of the colored material layer and parting layer when forming characters or images on an intermediate recording medium, thereby transferring the colored material onto the intermediate recording medium.

The ink sheet of the invention is also composed by laminating first and second colored material layers made of resin compositions largely different in viscosity or not compatible with each other on one surface of a substrate, in the sequence of the first and second colored material layers from the substrate side.

In the ink sheet of the invention, the first colored material layer is applied in about a double thickness of the first colored material necessary for obtaining a desired concentration.

In the ink sheet of the invention, the second colored material layer contains carbon black by 30 wt. %, and the coating weight on the substrate is 3 g/m$^2$ or less.

The outline of the action of the invention is described below.

The thermal transfer intermediate recording medium made of homogeneous, soft silicone rubber is required to possess the properties of temporarily receiving the fused ink or resin thermally transferred thereon, transferring and fixing the whole amount of the recorded matter by the fused ink or resin received on an image receiving medium such as paper, and not leaving any part of the recorded matter on the rubber if used continuously. Therefore the intermediate recording medium is required to have an appropriate releasability on the ink or recorded matter during continuous use. Accordingly, as the properties of rubber surface, a small surface roughness, a small surface energy (that is, a small contact angle), and a large density are demanded. In particular, instead of raising the density by inorganic additives, a dense rubber by raising the crosslinking density of the rubber material is important. Besides, to obtain a high releasability, it is important to decrease the content of inorganic activities and raise the density of the dimethyl siloxane radicals on the rubber surface.

At the same time, as the properties of the thermally fusible ink, it is required to possess the capability of recording favorably even on silicone rubber having a far lower receptivity of ink as compared with the conventional image receiving medium such as paper, and a sufficient strength for transferring the whole volume completely from the intermediate recording medium to the image receiving medium when transferring on the image receiving medium. Accordingly, when recording on the intermediate recording medium, it is required that the ink may be easily separated from the ink sheet to be transferred on the intermediate recording medium, and when transferring on the paper, it is important to keep the adhesion to the image receiving medium and the ink viscosity sufficiently larger than the adhesion to the intermediate recording medium.

Hence, when recording on the intermediate recording medium, the fused ink is held temporarily only on the rubber surface, and part of the ink will not permeate into the rubber, so that the whole volume of the ink can be always transferred onto the image recording medium. Even by continuous use, stable recording without transfer residue on the intermediate recording medium may be possible. In addition, because of an appropriate rubber layer thickness, stable recording is possible if there is any warp of recording head, and even if the image receiving medium is a coarse material such as bond paper, the characters and images recorded on the rubber can be stably fixed along the surface of the paper. Yet, since the ink layer is composed so as to be securely isolated from the ink sheet in a specific thickness, it is possible to use plural times by composing the ink layer in a multiple-layer structure.

In this constitution, the releasability of the thermal transfer intermediate recording medium hardly deteriorates, and the condition range for transferring the thermally fusible ink completely onto an image receiving paper is broad, and therefore character recording, multi-color images, and full-color images can be continuously duplicated on plain paper or bond paper very stably and at high quality, in tens of thousand of copies.

DESCRIPTION OF PREFERRED EMBODIMENTS

Figure 1:
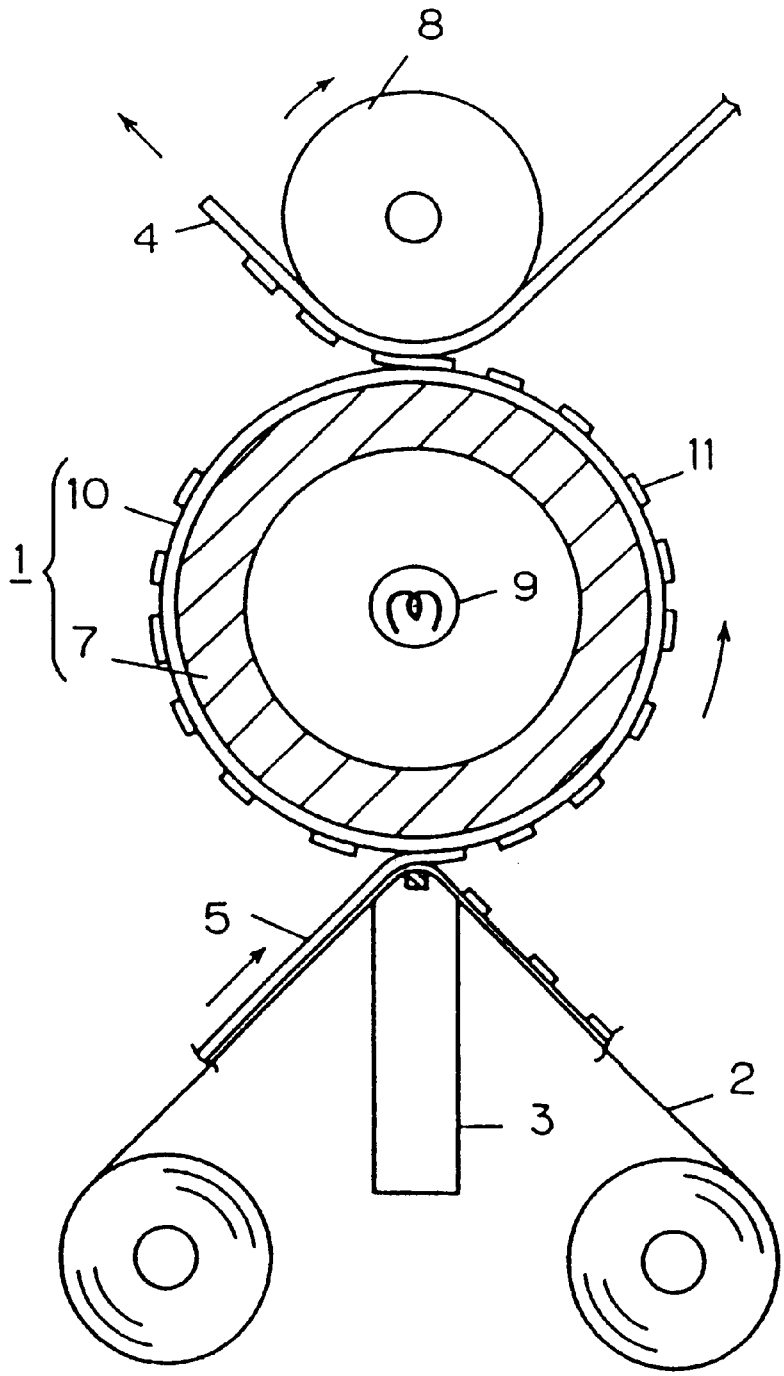
FIG. 1 is a drawing showing a first embodiment of a thermal recording method of the invention and an ink sheet used therein.

As shown in FIG. 1, a thermal transfer intermediate recording medium 1 is composed of a thin silicone rubber layer 10 formed on a metallic drum (roll) 7 of aluminum or the like. Inside the metallic drum 7, a heater 9 is provided, and the surface of the silicone rubber layer 10 is heated so as to keep a specific temperature.

On the silicone rubber layer 10, a colored material layer 5 of thermally fusible ink sheet 2 is recorded by thermal transfer by a thermal head 3. Consequently, an image 11 of the colored material transferred on the silicone rubber layer 10 is transferred and fixed on an image receiving medium 4 such as paper which passes between a fixing roll 8 and the thermal transfer intermediate recording medium 1. Since the silicone rubber layer 10 is composed of a homogeneous material, characters and images of high quality can be recorded thereon, and owing to the flexibility and releasability of the rubber, and the appropriately adjusted viscosity of the colored material, layer 5 of the ink sheet 2 a recorded matter free of defects such as voids and excellent in fixing performance can be fabricated along the irregularities of the paper texture.

The hardness of the silicone rubber 10 is preferred to be 20 to $500^{HS}$ (the hardness according to the JIS A method). In particular, in order that the image 11 of colored material can be transferred and fixed along the texture irregularities of the paper 4 it is preferred to be $40^{HS}$ or less. To reduce the fixing load to the image receiving medium 4, the thickness of the silicone rubber layer 10 should be 1 mm or less, and at this time when the recording width is 210 mm, a favorable fixing image is obtained even on a bond paper with a Bekk smoothness of 3 seconds or less at a load of about 20 kgf. When the thickness of the silicone rubber layer 10 exceeds 1 mm, the fixing load increases, and it is difficult to realize a practical recording apparatus. When the surface of the silicone rubber layer 10 is heated to about 70° C. by the heater 9, the fixing performance of the image is further enhanced. The lower limit of the thickness of the silicone rubber layer 10 is preferably 0.2 mm, so that it is possible to observe an ordinary warp of about 0.1 mm in a line type thermal head or the like, and homogeneous recording may be enabled. However, using a shuttle type thermal head, the lower limit of thickness of the silicone rubber layer 10 may be about 0.01 mm.

In order to keep always a stable and satisfactory releasability, the surface roughness of the silicone rubber layer 10 may be about 5 microns or less, more preferably 1 micron or less. Most preferable is a mirror-smooth surface with surface roughness of about 0.1 micron by free surface at the time of forming rubber film. It may be also possible to form by a die finished to a homogeneous surface by plating or the like.

Figure 7:
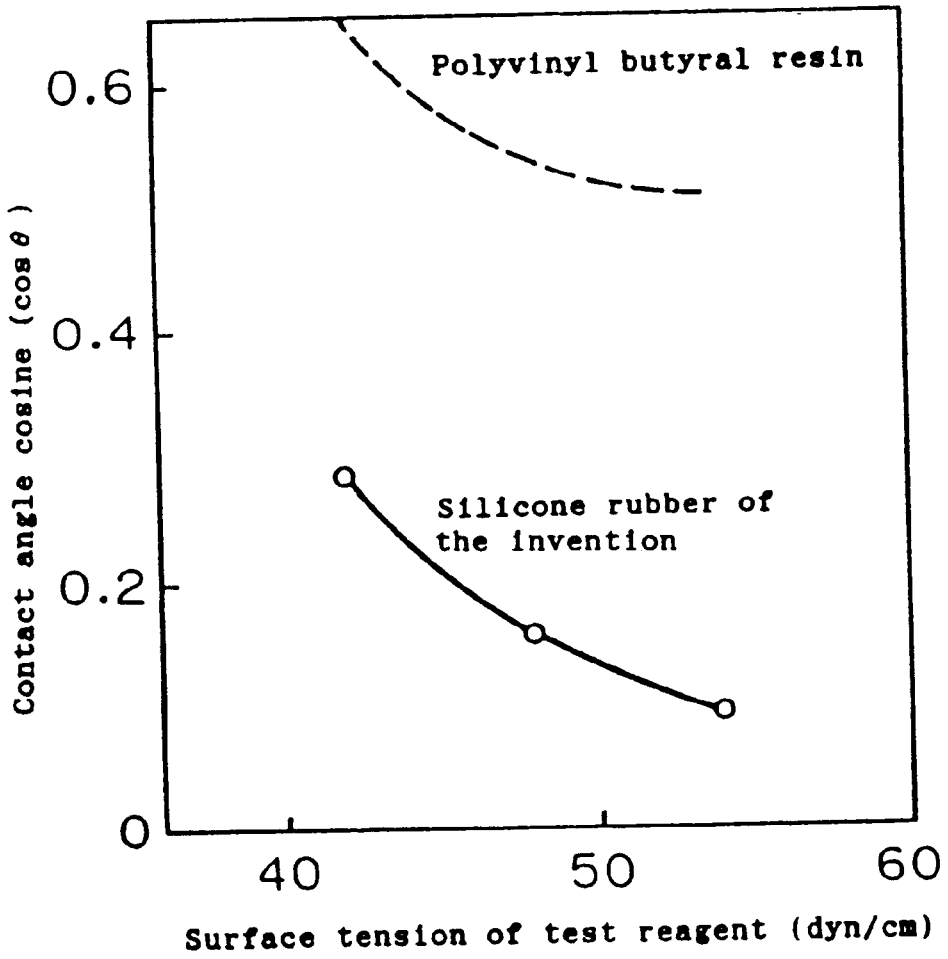
FIG. 7 is a diagram showing a characteristic of a thermal transfer intermediate recording medium of the invention.

From chemical point of view, in order to enhance the releasability, it is desired to raise the density of methyl radicals on the rubber surface, and lower the surface energy. The cosine of the contact angle defined at the measured value when the surface tension of the test reagent is 45 dyn/cm or more is desired to be 0.4 or less. FIG. 7 shows Zisman plotting for estimating the solid surface energy, summing up the general thermoplastic resin and silicone rubber of the invention.

Generally, the density of the silicone rubber layer 10 is demanded to be high, and is preferably 1.0 or more. When inorganic additive is not contained, the density is desired to be 0.90 to 1.15. If over 1.15, the hardness is too high, and it is not suited to the purpose of the invention. That is, in a denser rubber, permeation of part of thermally recorded colored material or resin into the rubber is less, and the whole volume of the colored matter recorded on the silicone rubber layer 10 can be transferred onto the image receiving medium, and deterioration due to continuous use is also less. This is an important matter practically. The apparent density of rubber is increased by inorganic additive such as silicon, but a better result is obtained by elevating the crosslinking density of the rubber material. Addition of inorganic material to rubber is a large factor of increasing the adhesion of the colored material and silicone rubber layer 10 at the time of recording, and enlarging the transfer residue. Therefore, the addition of silicon to the rubber should be as small as possible in a range of maintaining the mechanical strength of the rubber, and is preferred to be 20 wt. % or less. Most preferably, inorganic additive should not be contained. When adding silicon, instead of merely dispersing, by coupling reaction with silicone rubber using silane-treated silicon, a favorable result is brought about for increase of rubber strength. To enhance the releasability of rubber surface, eliminating the inorganic additive, it is desired to raise the density of dimethyl siloxane radicals on the rubber surface. Incidentally, the coefficient of friction of rubber on plain paper is preferred to be 2 or less. If more than 2, the rubber comes to have tackiness, and the releasability is lowered. At 0.5 or less, although the releasability is improved, the recording performance of ink is lowered, or problems may be caused in driving of the ink sheet 2 by the thermal transfer intermediate recording medium 1, or in driving of the image receiving medium 4. Hence, the coefficient of friction to plain paper of 1 to 1.5 is desired.

The silicone rubber of the invention is formed by using one or more types of polyorganosiloxane (crude rubber) as raw material, adding and blending with reinforcing fillers such as silicon, adding crosslinking agent, polymerization initiator, catalyst or the like, and heating to perform condensation polymerization or addition polymerization. The millable type silicone rubber called HTV method is used for this purpose. The condensation type or addition type silicone rubber called RTV is also used for this purpose. Moreover, the silicone rubber called LTV is also effective for the invention. Among them, in particular, the methyl vinyl derivative addition polymerization type is useful. Not limited to it, however, dimethyl, methyl phenyl vinyl. methyl fluoroalkyl derivatives, and their compound condensation polymerization and addition polymerization types can be also used.

Also useful is the rubber having part of the methyl radical of rubber replaced by a radical containing fluorine or carbon fluoride. One of the reasons of high releasability of silicone rubber lies in the smallness of solubility parameter (SP value). The SP value of silicone rubber is about 5, which is far smaller than 6 of Teflon, or 9 to 10 of ordinary resin.

Figure 8:
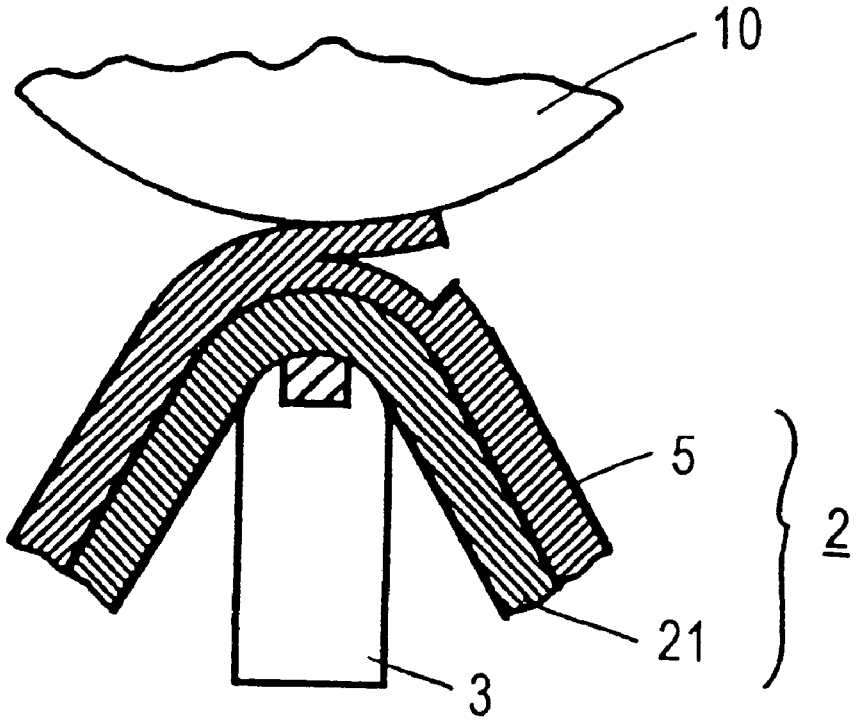
FIG. 8 is a drawing explaining a form of application of recording principle into silicone rubber.
Figure 9A:
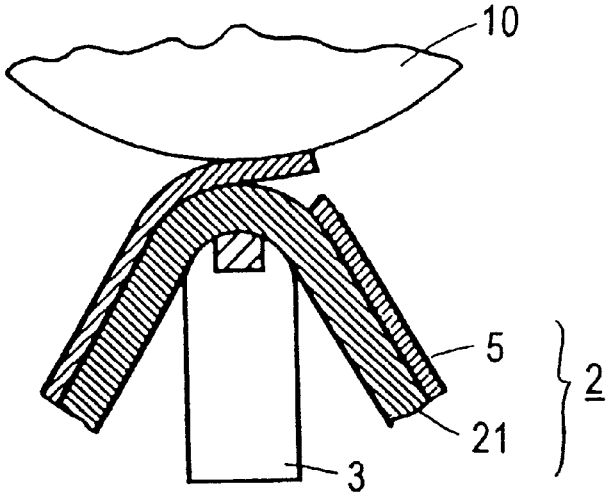
FIGS. 9(*a*) and 9(*b*) are drawings explaining other form of application of recording principle into silicone rubber.
Figure 9B:
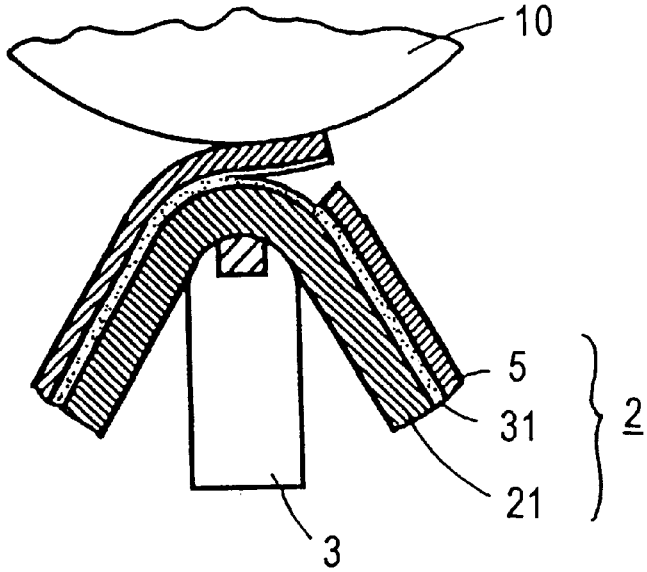

The viscosity of the colored material layer 5 is determined in consideration of the re cording performance on the thermal transfer intermediate recording medium 1, transfer on the image receiving medium 4, and fixing of image after transfer, and it is desired to be 500 to 2,000,000 cps at 100° C. Image forming on the thermal transfer intermediate recording medium 1 is available in two forms: one is a form of transferring into the silicone rubber layer 10 by destroying the cohesion of the colored material layer 5 within the layer as shown in FIG. 8, and the other is a form of transferring the entire layer of the colored material layer 5 onto the silicone rubber layer 10 as shown in FIG. 9(*a*) and (*b*). The latter is further divided into the form of peeling the colored material layer 5 from the interface with the substrate 21 such as PET (a), and the form of disposing a parting layer 31 beneath the colored material layer 5 and transferring by destroying the cohesion of the parting layer 31(*b*).

In order to form an image 11 of colored material by destroying the cohesion of the colored material layer 5 within the layer, on the silicone rubber layer 10 very high in releasability, the viscosity of the colored material layer 5 is desired to be 500 to 50,000 cps. This is because part of the image 11 of the colored material is left over on the thermal transfer intermediate recording medium 1 when transferring onto the image receiving medium 4 if the cohesive force of the image 11 of the colored material at the temperature of transferring the image 11 of the colored material onto the image receiving medium 4 is smaller than the adhesion of the silicone rubber layer 10 and colored material image 11, or the image 11 of the colored material may not be stably formed on the silicone rubber layer 10 if the cohesive force of the colored material layer 5 at the temperature when peeling the ink sheet 2 off the thermal transfer intermediate medium 1 is large when forming the colored material image 11. In order to transfer the whole volume of the colored material image 11 on the silicone rubber layer 10 onto various image receiving media 4 such as plain paper and bond paper, by overcoming the adhesion to the silicone rubber layer 10 in a wide range, in spite of difference in fixing pressure in the axial direction due to fluctuations of surface temperature of the silicone rubber layer 10 and axial deflection of the metallic drum 7, or changes in releasability and surface roughness due to deterioration, the viscosity of the colored material layer 5 is more preferred to be 5,000 to 50,000 cps. To separate the entire layer of the colored material layer 5 and form the image 11 of the colored material, the adhesion on the interface to the layer beneath the colored material layer 5 or the substrate 21 such as PET, or the cohesive force of the parting layer 31 should be smaller than the adhesion of the silicone rubber layer 10 and colored material layer 5. In this case, if the viscosity of the colored material layer 5 is too low, the colored material layer 5 is easily destroyed in cohesion, and therefore the viscosity is desired to be high. Also considering the transfer of whole volume onto the image receiving medium 4 and the fixing stability after transfer, the viscosity is also preferred to be high. If, however, the viscosity is too high, shearing is hardly to occur at the boundary of the image area and non-image area of the colored material layer 5 when transferring onto the silicone rubber layer 10, and if the image receiving medium 4 is a fibrous matter such as paper, permeation of the colored material image 11 into the image receiving medium 4 is difficult at the time of transfer, which causes to lower the quality. Therefore, in this case, the viscosity of the colored material layer 5 is preferred to be 20,000 to 2,000,000 cps.

In order to obtain a favorable fixing strength by smoother permeation of the colored material layer 5 into the image receiving medium 4 when transferring and fixing on the image receiving medium 4 the molecular weight of the EVA, (ethylene-vinyl acetate copolymer) in the solid components of the colored material layer 5 is desired to be small. It is particularly preferred to be weight-average molecular weight of 10,000 or more to 100,000 or less. As the wax to be added for adjusting the viscosity, a paraffin derivative wax with weight-average molecular weight of 1,000 or less is desired.

It is a preferred method to dispose a parting layer 31 having a lower viscosity than the colored material layer 5, between the substrate 21 such as PET and the colored material layer 5. If the cohesive force of the coloring material layer 5 Is larger than the adhesion of the silicone rubber layer 10 and colored material layer 5, as far as the parting layer 31 having a smaller cohesive force is destroyed, in cohesion, or the interface is peeled off or destroyed in cohesion near the interface of the parting layer 31 and colored material layer 5, the colored material layer 5 can be transferred onto the silicone rubber layer 10.

Practical embodiments are shown below.

Preparation of thermal transfer intermediate recording medium 1

A PET film having a thickness of 50 microns was coated with a silicone rubber layer 10 in a thickness of 0.4 mm by addition polymerization employing the following LTV process, and this PET film 21 was wound around a metallic drum 7 made of aluminum, accommodating a halogen lamp 9 capable of heating the rubber up to 70° C. to be used as a thermal transfer intermediate recording medium 1.

Using crude rubber of methyl vinyl derivative with siloxane units of about 5,000 as raw material, silane-treated silicone was added by 5 wt. %, and cross-linked for 1 hour at 150° C., using a platinum catalyst, and silicone rubber was obtained.

Preparation of thermally fusible ink sheet 2

A smooth heat-resistant layer of 0.3 microns was disposed in the reverse side of a PET film 21 of 6 microns in thickness, and a colored material layer 5 having the following solid composition ratio was formed on the surface side in a thickness of 8 microns.

Wax (molecular weight 640): 28 wt. %

Ethylene-vinyl acetate copolymer (molecular weight 44,000): 65 wt. %

Carbon black: 7 wt. %

Image formation

Using the thermal transfer intermediate recording medium 1 and thermally fusible ink sheet 2, the thermally fusible ink was recorded on the thermal transfer intermediate recording medium 1 by a thermal head 3, and was immediately transferred and fixed on a bond paper 4, and a recorded image of high quality was obtained. After recording a total of 100,000 copies on bond paper of 210×297 mm, there was no disturbance in the recorded image. The image was formed in the following condition.

Thermal head: 210 mm, resolution of 12 dots/mm

Recording line speed: 2 ms/line

Transfer, fixing pressure: 20 kgf/210 mm width

Figure 2:
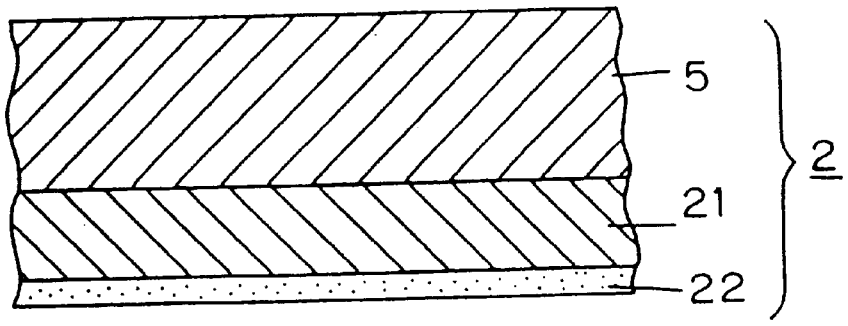
FIG. 2 is a drawing showing a first embodiment of an ink sheet used in the thermal recording method of the invention.

FIG. 2 is a sectional view showing the constitution of the thermally fusible ink sheet 2 of the invention. As shown in FIG. 2, the colored material layer 5 is applied on one side of the substrate PET 21. The viscosity of the colored material layer 5 at 100° C. is 6,000 cps, and the coating thickness is 8 microns. On the other side of the PET 21, a smooth heat resistant layer 22 for protecting from friction and heat with the thermal head 3 is applied. In the composition of the thermally fusible ink sheet 2 of the embodiment, the quality of image formation on the thermal transfer intermediate recording medium 1 is determined by the magnitude of the adhesion of the silicone rubber layer 10 and colored material layer 5/adhesion of PET 21 and colored material layer 5/cohesive force of the colored material layer 5. The colored material layer 5 having such composition is generally high in affinity for PET 21, and its adhesion is far stronger than the adhesion to the silicone rubber layer 10. Therefore, when the viscosity of the colored material layer 5 at 100° C. is set at 500 to 50,000 cps, the portion selectively heated by the thermal head 3 (usually 150 to 200° C. or higher) is lowered in the viscosity, and the cohesive force drops, and the colored material layer 5 is destroyed in cohesion from around the middle of the layer, and about half of the colored material layer 5 is transferred onto the silicone rubber layer 10. In the case of the colored material of this embodiment, the required amount of colored material necessary for obtaining, for example, the optical density of 1.4 is about 4 microns, and therefore the coating amount of the colored material on the thermally fusible ink sheet 2 is about 18 microns.

In this way, by disposing the colored material layer 5 in a double amount than necessary for transferring onto the image receiving medium 4 on the PET 2, the ink sheet used in the thermal recording method of the invention may be presented in a simplest constitution.

A second embodiment of the invention is described below while referring to FIG. 3.

Figure 3:
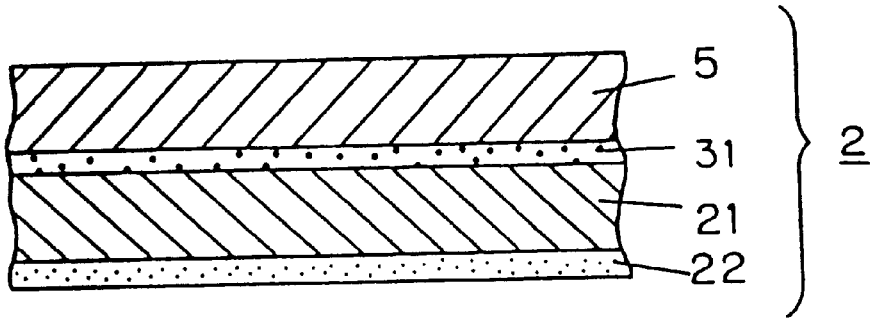
FIG. 3 is a drawing showing a second embodiment of an ink sheet used in the thermal recording method of the invention.

FIG. 3 is a sectional view showing the composition of the ink sheet in the second embodiment of the invention. In FIG. 3, numeral 31 denotes a parting layer applied on one side of the PET 21, and it is mainly composed of wax (molecular weight 1500), and the viscosity at 100° C. is adjusted at 10 cps. The coating thickness of the parting layer 31 is 1 micron. The colored material layer 5 is in the same composition as in the first embodiment, except that the blending rate of the ethylene-vinyl acetate copolymer is raised so that the viscosity at 100° C. may be 100,000 cps. Its coating thickness is 4 microns. The quality of image formation on the thermal transfer intermediate recording medium 1 is determined by the magnitude of the adhesion of silicone rubber layer 10 and colored material layer 5/adhesion of PET 21 and parting layer 31/cohesive force of colored material layer 5/cohesive force of parting layer 31/adhesion on interface of colored material layer 5 and parting layer 31, and in the constitution as described above, by and destroying the cohesion from around the middle of the layer of the parting layer 31, or peeling around the interface of the colored material layer 5 and parting layer 31, the colored material layer 5 is transferred onto the silicone rubber layer 10. This is because the viscosity of the parting layer 31 is far smaller than the viscosity of the colored material layer 5, and the cohesive force of the parting layer 31 becomes the smallest among the forces mentioned above. If the wax component composing the parting layer 31 and the wax component contained in the colored material layer 5 are the same or of same derivative group, the parting layer 31 and colored material layer 5 are partly melted together when fused by the heat of the thermal head 3, and separation occurs at the weakest viscosity portion. If the wax was component composing the parting layer 31 is not miscible with the colored material layer 5, peeling occurs near the interface of the parting layer 31 and colored material layer 5. The viscosity of the colored material layer 5 in this embodiment can be set higher than the viscosity of the colored material layer 5 in the first embodiment, which is because the cohesive force of the parting layer 31 is as small as ignorable, and substantially only the shearing force of the colored material layer 5 acts in this embodiment, when transferring the colored material layer 5 onto the silicone rubber layer 10, whereas, in the first embodiment, the shearing force in the boundary of the image area and non-image area of the colored material layer 5 and the cohesive force for cutting within the layer of the colored material layer 5 both act.

Thus, by disposing the parting layer 31 of low viscosity beneath the colored material layer 5, the ink sheet to be used in the thermal recording method of the invention can be presented, without increasing the coating thickness of the colored material. Besides, by peeling off from the ink sheet 2 in the parting layer 31, the colored material may be set at higher viscosity, and fixing to the image receiving paper 4 can be enhanced.

A third embodiment of the invention is described below by reference to FIG. 4.

Figure 4:
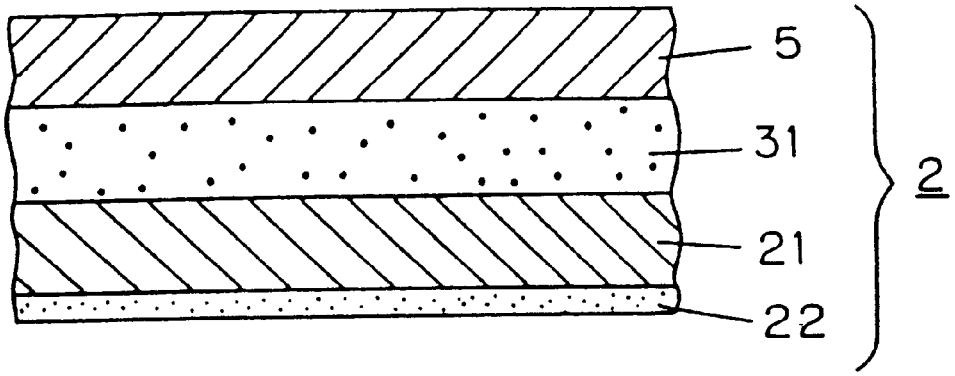
FIG. 4 is a drawing showing a third embodiment of an ink sheet used in the thermal recording method of the invention.

FIG. 4 is a sectional view showing the composition of the ink sheet in the third embodiment of the invention. What differs from the second embodiment is that the coating thickness of the parting layer 31 is 4 microns, same as that of the colored material layer 5. If a sufficient viscosity difference or non-compatibility is not obtained between the parting layer 31 and colored material layer 5, peeling occurs near the middle of the entire coating thickness on the ink sheet 2 when transferring onto the silicone rubber layer 10. Therefore, in the embodiment, since the coating thickness of the parting layer 31 and the colored material layer 5 is equal, nearly the colored material layer 5 only is transferred onto the silicone rubber layer 10, and the parting layer 31 almost only is left over on the ink sheet 2.

If a sufficient viscosity difference or non-compatibility is not obtained between the parting layer 31 and the colored material layer 5, similarly, the expensive colored material. is applied by a necessary amount, while the rest is replaced by the inexpensive parting layer 31 to be applied on the ink sheet 2, so that the cost may be lowered.

A fourth embodiment of the invention is described below by reference to FIG. 5.

Figure 5:
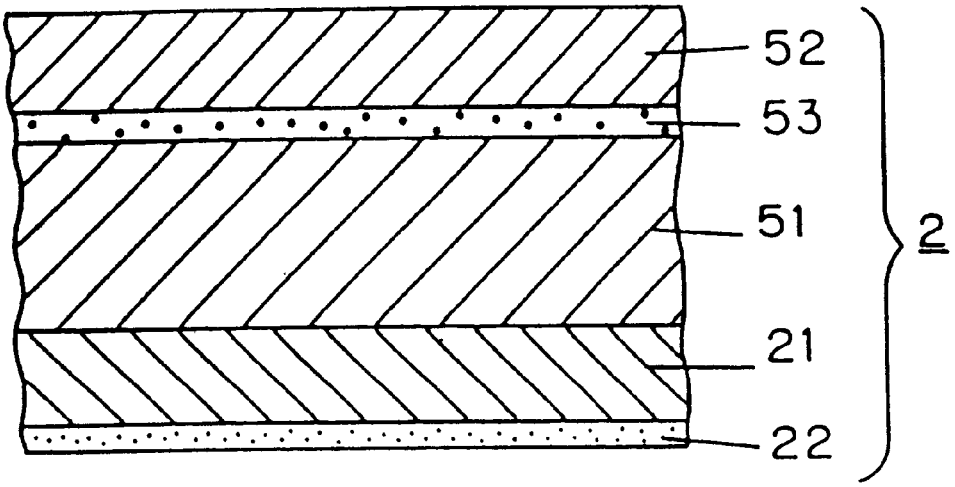
FIG. 5 is a drawing showing a fourth embodiment of an ink sheet used in the thermal recording method of the invention.

FIG. 5 is a sectional view showing the composition of the ink sheet in the fourth embodiment of the invention. In FIG. 5, numeral 51 is a first colored material layer applied on a PET 21 by hot-melt process, and its viscosity at 100° C. is 6,000 cps, and the coating thickness is 8 microns. Numeral 53 is a parting layer with overcooling property, which is applied on the first colored material layer 51, and its viscosity at 100° C. is 10 cps, and the coating thickness is 0.5 microns. The overcooling property refers to the nature of being cooled at the time of solidification (changing from liquid phase to solid phase), and keeping the liquid state if the temperature becomes lower than the melting point at the time of melting (changing from solid phase to liquid phase). Numeral 52 denotes a second colored material layer containing carbon black by at least 30 wt. %, and it is applied on a parting layer 53 by solvent; application method in a thickness range not exceeding 3 g/m$^2$. Therefore, as compared with the first colored material layer 51, the second colored material layer 52 possesses the viscosity at 100° C. of 100,000 cps, and the coating thickness of 3 microns.

Figure 10:
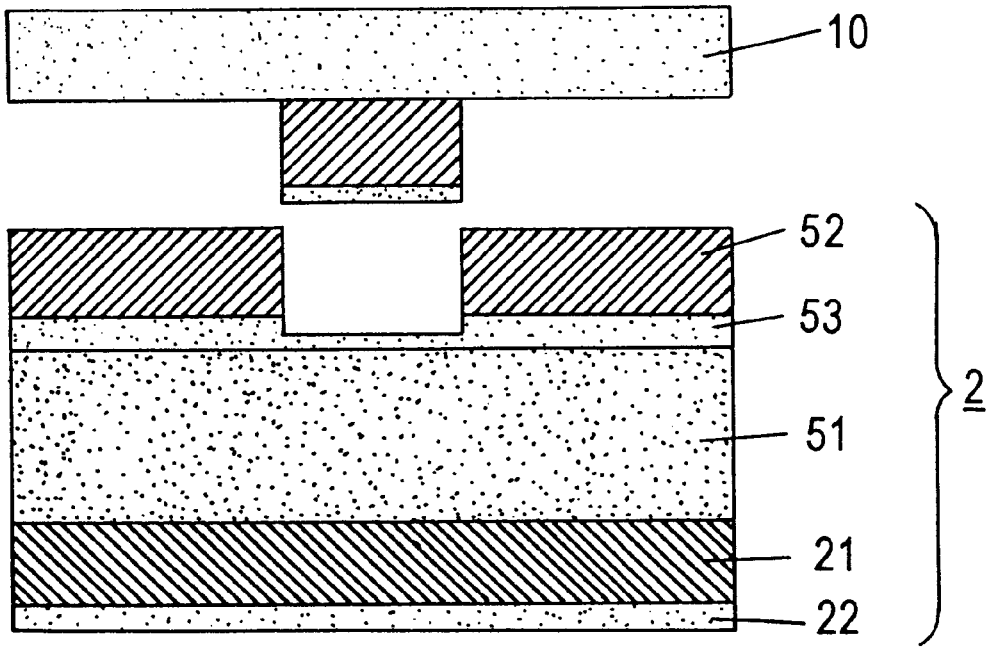
FIG. 10 is a drawing explaining the principle of first recording in the fourth embodiment.
Figure 11:
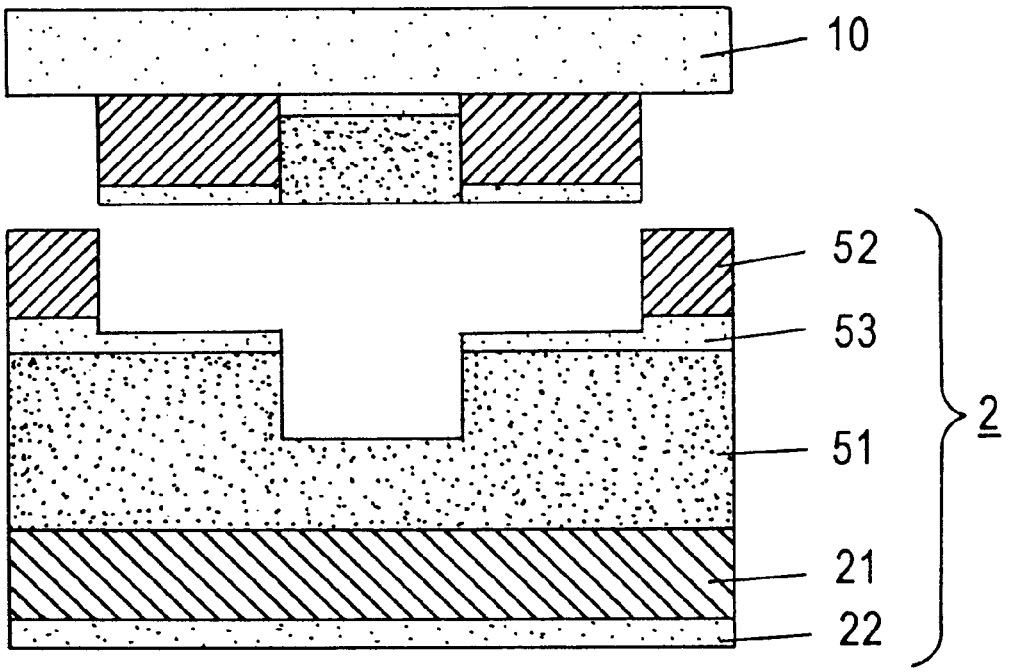
FIG. 11 is a drawing explaining the principle of second recording in the fourth embodiment.

The ink sheet 2 of this embodiment can be used two times in recording, as compared with the ink sheets in the foregoing embodiments that can be used one time only, and the recording action by using it is explained below. In the first recording, same as in the principle of the second embodiment, as shown in FIG. 10, only the second colored material layer 52 is transferred onto the silicone rubber layer 10. The ink sheet 2 after the first recording lacks the area of the second colored material layer 52 corresponding to the image. In the second recording, therefore, the second colored material layer 52 Is transferred to the non-image area in the first recording as shown in FIG. 11, whereas in the image area, the first colored material layer 51 is easily melted and its half is transferred to the silicone rubber layer 10 in the same principle as in the first embodiment, owing to the flexibility of the silicone rubber layer 10 and the low viscosity of the first colored material layer 51 which are features of this invention. In this embodiment, incidentally, the parting layer 53 is made of a material having overcooling property, which is because the transfer of the second colored layer 52 is made possible if the temperature of the parting layer 53 is lowered beneath its melting point in the course of the time from heating by the thermal head 3 and separation of ink sheet 2 from the silicone rubber layer 10. The content of the carbon black in the second colored material layer 52 in the embodiment is at least 30 wt. %, which is because the optical density of transferred image to the image receiving paper 4 is not lowered if the coating thickness of the second colored material layer 52 is less than 3 g/m2, and the step caused by the first recording can be decreased so that the second recording action may be perfect by reducing the coating thickness of the second colored material layer 52.

In this way, by disposing the first colored material layer 51 and second colored material layer 52 across the parting layer 53, and applying the first colored material layer 51 twice as much as required, the ink sheet capable of recording two times for use in the thermal recording method of the invention can be presented.

A fifth embodiment of the invention is described below by reference to FIG. 6.

Figure 6:
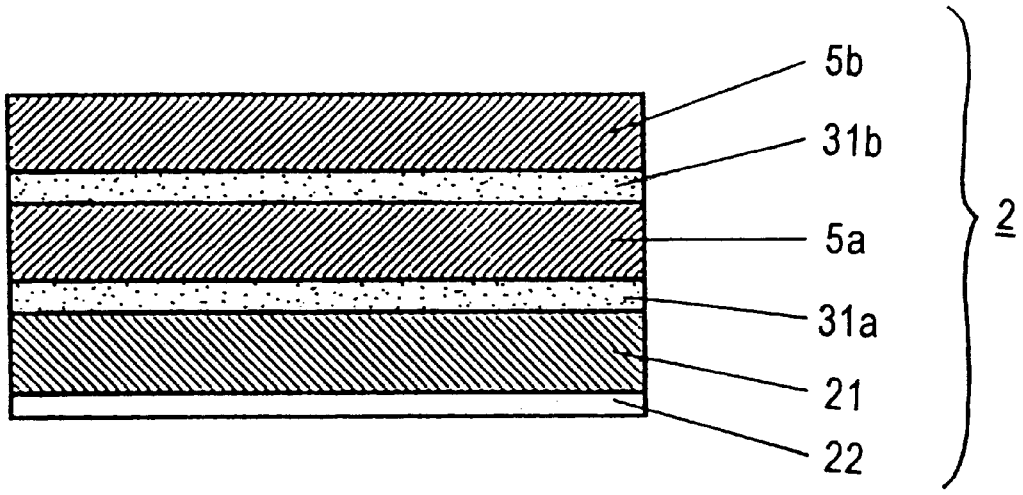
FIG. 6 is a drawing showing a fifth embodiment of an ink sheet used in the thermal recording method of the invention.

FIG. 6 is a sectional view showing the composition of the ink sheet 2 in the fifth embodiment of the invention. In FIG. 6, numerals 31*a*, 31*b* are parting layers, which are made of wax, same as in the second embodiment, and the viscosity at 100° C. is adjusted at 10 cps. Numerals 5*a*, 5*b* are colored material layers, of which viscosity at 100° C. is adjusted at 100,000 cps same as in the second embodiment. On one side of PET 21, the parting layer 31*a*, colored material layer 5*a*, parting layer 31*b*, and colored material layer 5*b* are sequentially laminated. The coating thickness is 1 micron in both parting layers 31*a*, 31*b*, and 4 microns in both colored material layers 5*a*, 5*b*.

Figure 12:
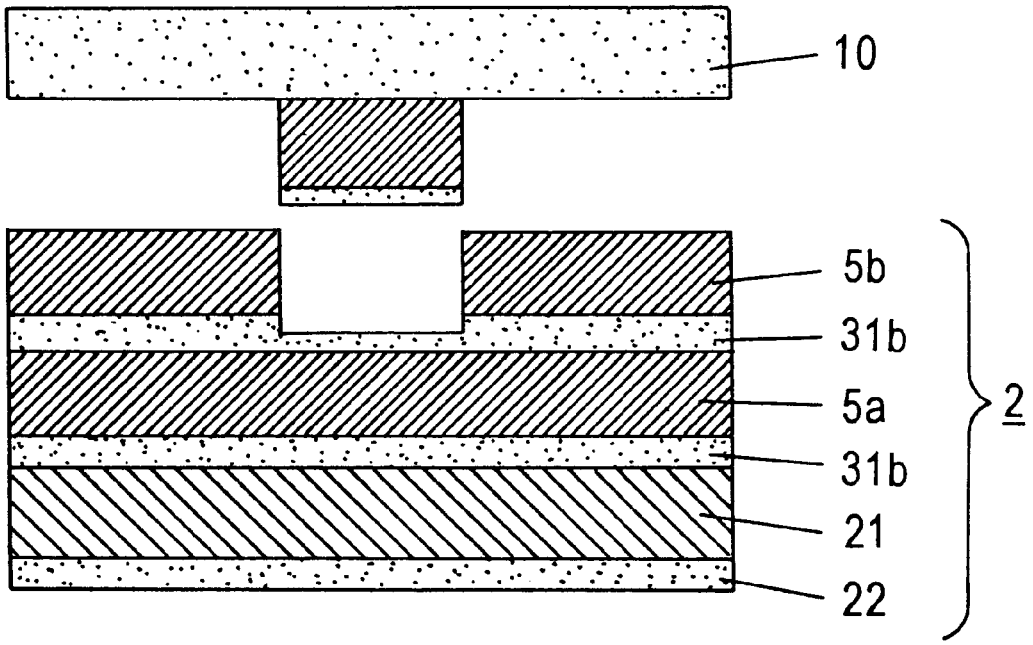
FIG. 12 is a drawing explaining the principle of first recording in the fifth embodiment.
Figure 13:
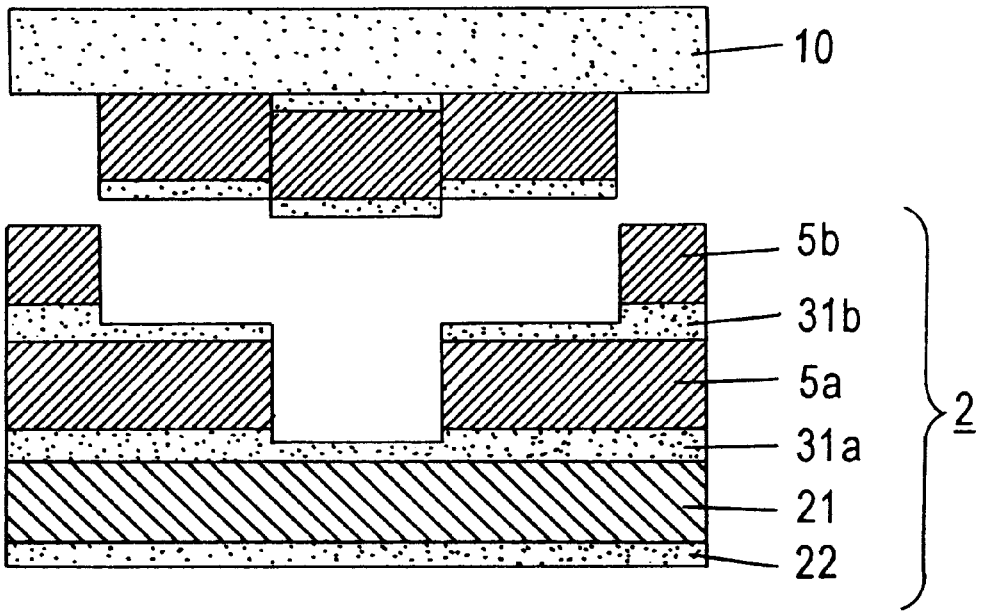
FIG. 13 is a drawing explaining the principle of second recording in the fifth embodiment.

The ink sheet 2 in this embodiment can be also recorded twice. The recording action is same as in the second embodiment. In the first recording, as shown in FIG. 12, being separated by the parting layer 31*b*, the colored material layer 5*b* is transferred on the silicone rubber layer 10. After the first recording, the ink sheet 2 lacks the colored material layer 5*b* corresponding to the image area. In the second recording, as shown in FIG. 13, in the non-image area in the first time, the colored material layer 5*b* is transferred same as in the first time, while in the image area, the colored material layer 5*a* is separated from the parting layer 31*a* and is transferred onto the silicone rubber layer 10.

Heating by the thermal head 3 is transmitted from the smooth heat-resistant layer 22 side, and the temperature of the ink sheet 2 is higher at the smooth heat-resistant layer 22 side right after heating. However, as the time passes by, the highest temperature point is shifted to the colored material layer 5*b* side, and since the silicone rubber layer 10 is kept at a specific temperature, the temperature of the parting layer 31*a* and parting layer 31*b* is inverted. (The parting layer 31*b* is hotter.) Therefore, by properly selecting the timing for separating the ink sheet 2, it is possible to record two times as mentioned above.

In this way, by setting the viscosity of the parting layers 31*a*, 31*b* at 100° C. at 10 cps, and the viscosity of the colored material layers 5*a*, 5*b* at 100° C. at 100,000 cps, the ink sheet capable of recording two times can be presented by making use of the temperature of the silicone rubber layer 10.

A sixth embodiment of the invention is described below by reference to FIG. 14.

Figure 14:
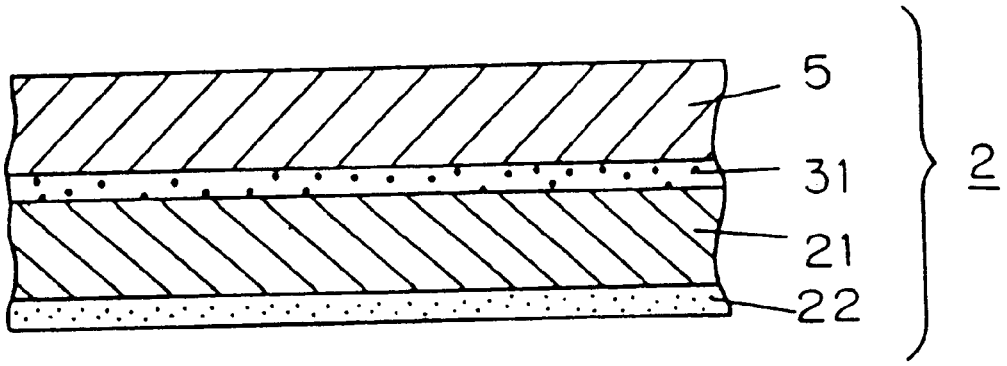
FIG. 14 is a drawing showing a sixth embodiment of an ink sheet used in the thermal recording method of the invention.

FIG. 14 is a sectional view showing the composition of the ink sheet in the sixth embodiment of the invention. In FIG. 14, numeral 31 denotes a parting layer, and its coating thickness is 1 micron. Numeral 5 is a colored coating layer, and its coating thickness is 4 microns. As mentioned in the third embodiment, if sufficient viscosity difference or non-compatibility is not obtained in the parting layer 31 and colored material layer 5, separation takes place near the middle of the entire coating thickness on the ink sheet 2 when transferring to the silicone rubber layer 10. Therefore, since the entire coating thickness is 5 microns in this embodiment, about 2.5 microns of the colored material layer will be transferred to the silicone rubber layer 10, and the parting layer 31 and the remaining 1.5 microns of colored material layer are left over on the ink sheet 2. When the parting layer 31 and colored material layer 5 are of same material composition, the parting layer 31 and colored material layer 5 are mixed together by the heat and pressure by the thermal head 3 or flow of ink when separating. By positively making use of this phenomenon, a viscosity gradient is formed in a thickness direction of the ink layer composed of the colored material layer 5 and parting layer 31, and even the colored material having such a viscosity as not to be transferred onto the silicone rubber layer 10 in the single layer of colored material layer can be transferred to the silicone rubber layer 10 by destruction of cohesion. Furthermore, since the colored material layer 5 transferred to the silicone rubber layer 10 i relatively high in viscosity, the whole volume can be easily transferred on the paper, and the ink near the adhesion surface to the paper is relatively low in viscosity, so that permeation to the paper is excellent.

Thus, if sufficient viscosity difference of non-compatibility is not obtained between the parting layer 31 and colored material layer 5, by forming the parting layer 31 in a smaller coating thickness than the thickness of the colored material layer 5, the ink sheet excellent in transfer properties even by using a colored material high in viscosity can be presented.

In the first, second, third, fourth and fifth embodiments, the required coating thickness of the colored material layer 5 was 4 microns, but it varies, needless to say, depending on the amount of carbon black contained in the colored material layer 5, or the desired optical density. The thickness of the PET 21 is defined as 6 microns, but it is not limited. The thermal recording head may be other recording means such as electric recording head, instead of the mentioned thermal head 3. The surface of the silicone rubber layer 10 is maintained at 70° C., but the surface temperature of the silicone rubber layer 10 should be properly set depending on the characteristics of the colored material layer 5 being used, or the ambient temperature. The heater 9 may not be needed if it is not necessary to heat up the silicone rubber layer 10. Instead of a hollow aluminum tube, the metallic drum 7 may be an aluminum bar if it is not necessary to provide the heater 9 inside, and the material may be also iron or other metal. The viscosity of the colored material layer 5 at 100° C. is specified to be 6,000 cps or 100,000 cps, but it is not limitative, and any appropriate value may be set depending on the releasability of the silicone rubber layer 10 or constitution of the apparatus. Incidentally, a mat layer may be provided for preventing dropout of the colored material between the PET 21 and colored material layer 5, or the first colored material layer 51 in the fourth embodiment, or the parting layer 31.

In the second and fifth embodiment, the coating thickness of the parting layer 31 is 1 micron, but the coating thickness of the parting layer 31 should be as thin as possible in a range of obtaining a sufficient releasability.

In the third embodiment, the parting layer 31 may be made of resin or wax similar to the composition of the colored material layer 5, and may have a similar pigment concentration as the colored material layer 5. That is, the parting layer 31 and colored material layer 5 are of same composition of colored material, differing only in the viscosity. Thus, separation or and destruction of cohesion may occur near the interface of the parting layer 31 and colored material layer 59 and if there is part of the parting layer 31 in the colored material layer 5 transferred to the thermal transfer intermediate recording medium 1, the concentration of the colored material is not changed by it, and many components of low viscosity are present at the side confronting the image receiving medium 4, so that the colored material layer 5 may easily permeate into the image receiving medium 4 when transferring, so that the transfer property is enhanced.

In the fourth embodiment, meanwhile, the parting layer 53 is provided, but it may not be necessary if separation occurs securely near the interface of the first colored material layer 51 and second colored material layer 52. Besides, by laminating the colored material layer in three layers or more, it is possible to form an ink sheet capable of recording more times.

In the fifth embodiment, by alternately laminating the parting layers 31*a*, 31*b*, and colored material layers 5*a*, 5*b*, it is made possible to record two times, but it is also possible to record three or more times by laminating the parting layer and colored material layer further thereon to make up six or more layers. It is possible to record two times securely, by setting the parting layer 31*a* and parting layer 31*b* at different viscosities at 100° C.

We claim:

1. A thermal recording method, using a thermal recording apparatus comprising an intermediate recording medium made of silicone rubber layer, having a surface thickness 1 mm or less, surface roughness 5 microns or less, contact angle cosine 0.4 or less, density 0.90 to 1.15, and rubber hardness 20 to $50^{HS}$, a fixing roll for pressing against the intermediate recording medium, a thermal recording head, and an ink sheet produced in a process including laminating a first layer and a second layer on one surface of a substrate, in approximately the same thickness, in the sequence of the first layer and the second layer from a side of the substrate, said ink sheet having a viscosity of the first layer on the substrate at 100° C. of 10 cps or more and having a viscosity of the second layer on the substrate at 100° C. of 100,000 cps or less, but more than that of the first layer, and said second layer having a colored material, the method comprising:

selectively heating the second layer on the ink sheet by the thermal recording head to transfer the colored material on the intermediate recording medium so as to record characters and images;

destroying coagulation near the middle of the entire coating thickness of the first layer and the second layer, having approximately the same thickness, when forming characters or images on the intermediate recording medium, thereby transferring substantially only the second layer onto the intermediate recording medium; and passing an image receiving medium between pressing parts of the intermediate recording medium and the fixing roll, and transferring or fixing the characters and images by the second layer transferred on the intermediate recording medium onto the receiving medium so as to be recorded.

2. The thermal recording method according to claim 1, wherein the first layer possesses a nearly same pigment concentration as the second layer.

3. The thermal recording method according to claim 1, wherein the first layer possesses a nearly same pigment concentration as the second layer, and at least similar resin.

4. The thermal recording method according to claim 1, wherein the first layer possesses a nearly same pigment concentration as the second layer, and at least similar wax.

5. The thermal recording method according to claim 1, wherein the second layer comprises ethylene-vinyl acetate copolymer with weight-average molecular weight of 10,000 or more, and wax with the weight-average molecular weight of 1,000 or less.

6. The thermal recording method according to claim 1, wherein the image receiving medium is a recording paper.

7. The thermal recording method according to claim 1, wherein the viscosity of the second layer is 5,000 to 50,000 cps.

8. A thermal recording apparatus comprising:

an intermediate recording medium made of silicone rubber layer, said silicone rubber layer having a surface thickness of 1 mm or less, surface roughness of 5 microns or less, contact angle cosine of 0.4 or less, density of 0.90 to 1.15, and rubber hardness of 20 to $50^{HS}$;

an ink sheet including a substrate, a first layer, and a second layer, approximately the same thickness as the first layer and having a colored material layer, said first layer and second layer being laminated on one surface of the substrate in the sequence of the first layer and the second layer from a side of the substrate, a viscosity of the first layer on the substrate at 100° C. being 10 cps or more, and a viscosity of the second layer on the substrate at 100° C. being 100,000 cps or less, but more than that of the first layer;

a thermal recording head for selectively heating the second layer on the ink sheet to transfer the second layer onto the intermediate recording medium so as to record characters and images thereon, coagulation near the middle of the entire coating thickness of the first layer and the second layer being destroyed when recording characters or images on the intermediate recording medium, thereby transferring substantially only the second layer onto the intermediate recording medium; and a fixing roll for pressing against the intermediate recording medium and transferring or fixing the characters and images recorded on the intermediate recording medium onto an image receiving medium passing between pressing parts of the intermediate recording medium and the fixing roll.

9. The thermal recording apparatus according to claim 8, wherein the image receiving medium is a recording medium.

10. An ink sheet for a thermal recording apparatus comprising:

a substrate;

a first layer; and a second layer having a colored material, said first layer and second layer being on one surface of the substrate, in approximately the same thickness, in the sequence of the fit layer and the second layer from a side of the substrate, a viscosity of the first layer on the substrate at 100° C. being 10 cps or more and a viscosity of the second layer on the substrate at 100° C. being 500 to 100,000 cps, said ink sheet to be used in a thermal recording apparatus.

* * * * *